US007753692B2

(12) United States Patent
Hsu et al.

(10) Patent No.: US 7,753,692 B2
(45) Date of Patent: Jul. 13, 2010

(54) SOCKET CONNECTOR HAVING IMPROVED ARRANGEMENT ENSURING RELIABLE AND ROBUST ALIGNMENT BETWEEN CONDUCTIVE CONTACTS

(75) Inventors: Shuo-Hsiu Hsu, Tu-Cheng (TW); Nan-Hung Lin, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/619,688

(22) Filed: Nov. 17, 2009

(65) Prior Publication Data

US 2010/0124828 A1 May 20, 2010

(30) Foreign Application Priority Data

Nov. 17, 2008 (TW) ..... 97220534

(51) Int. Cl.
*H01R 12/00* (2006.01)

(52) U.S. Cl. ..... 439/70; 439/71

(58) Field of Classification Search ..... 439/70, 439/71, 630
See application file for complete search history.

(56) References Cited

U.S. PATENT DOCUMENTS

| | | | | |
|---|---|---|---|---|
| 6,908,316 | B2 | 6/2005 | Ma | |
| 7,108,558 | B2 * | 9/2006 | Zhu et al. | 439/630 |
| 7,248,481 | B2 * | 7/2007 | Trobough | 439/66 |

* cited by examiner

*Primary Examiner*—Tho D Ta
(74) *Attorney, Agent, or Firm*—Wei Te Chung; Andrew C. Cheng; Ming Chieh Chang

(57) ABSTRACT

A socket connector comprises an insulative housing defining a plurality of passageways and a receiving cavity for receiving an electrical package, and a plurality of contact respectively disposed in said passageways. The receiving cavity comprises a first cavity, and a second cavity smaller than the first cavity. The second cavity is in communication with the first cavity and outer space, the second cavity defining standoffs for positioning the electrical package when the electrical package is inserted into the receiving cavity.

11 Claims, 7 Drawing Sheets

SOCKET CONNECTOR HAVING IMPROVED ARRANGEMENT ENSURING RELIABLE AND ROBUST ALIGNMENT BETWEEN CONDUCTIVE CONTACTS

BACKGROUND OF THE INVENTION

1. Field of the Invention

The present invention relates to a socket connector, and more particularly to a socket connector having an aligning arrangement ensuring reliable and robust alignment between contact terminals and conductive pads of an electronic package immediately after the package is seated in.

2. Description of Prior Art

Land Grid Array (LGA) sockets are known for using in the art of the electronic, for electrically connecting two electrical components, such as an electrical package and a PCB.

U.S. Pat. No. 6,908,306 issued to Ma on Jun. 21, 2005 discloses an LGA socket, which provides an insulative housing embedded with a plurality of contacts and formed with a receiving cavity. Each of sidewalls of the receiving cavity of the insulative housing defines at least one protrusions extending toward a center of the cavity, for positioning the electrical package in the cavity.

In Ma's art, referring to FIG. 2; the protrusions are evenly disposed at periphery of the electrical package. However, dimensional tolerance of the electrical package may be varied in a variety of ranges due to manufacture art. Therefore, during insertion or disposal of the electrical package inserted into the cavity, enough clearance between periphery surface of the package and top end of the protrusions is required. Otherwise, the Electrical package will be damaged or unable to be inserted into the cavity under worse case or due to incorrect operation. On the other hand, if the clearance is too large, the socket is hardly to ensure accurate positioning and contacting between the contacts and pads of the electrical package.

In view of the above, an improved electrical connector that overcomes the above-mentioned disadvantages is desired.

SUMMARY OF THE INVENTION

Accordingly, an object of the present invention is to provide a socket connector, and more particularly to a socket connector having an aligning arrangement ensuring reliable and robust alignment between contact terminals and conductive pads of an electronic package immediately after the package is seated in.

To achieve the above-mentioned object, an electrical connector in accordance with a preferred embodiment of the present invention for electrically connecting an electrical package with a PCB is provided. The electrical connector comprises an electrical connector comprising an insulative housing defining a plurality of passageways and a receiving cavity for receiving an electrical package, and a plurality of contacts respectively disposed in said passageways. The receiving cavity comprises a first cavity, and a second cavity smaller than the first cavity. The second cavity is in communication with the first cavity and outer space, the second cavity defining standoffs for positioning the electrical package when the electrical package is inserted into the receiving cavity. In use, the standoffs of the second cavity are used for positioning a small size portion of the electrical package. Therefore, it is easily to implement than conventional art even under worse case.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Figure 1:
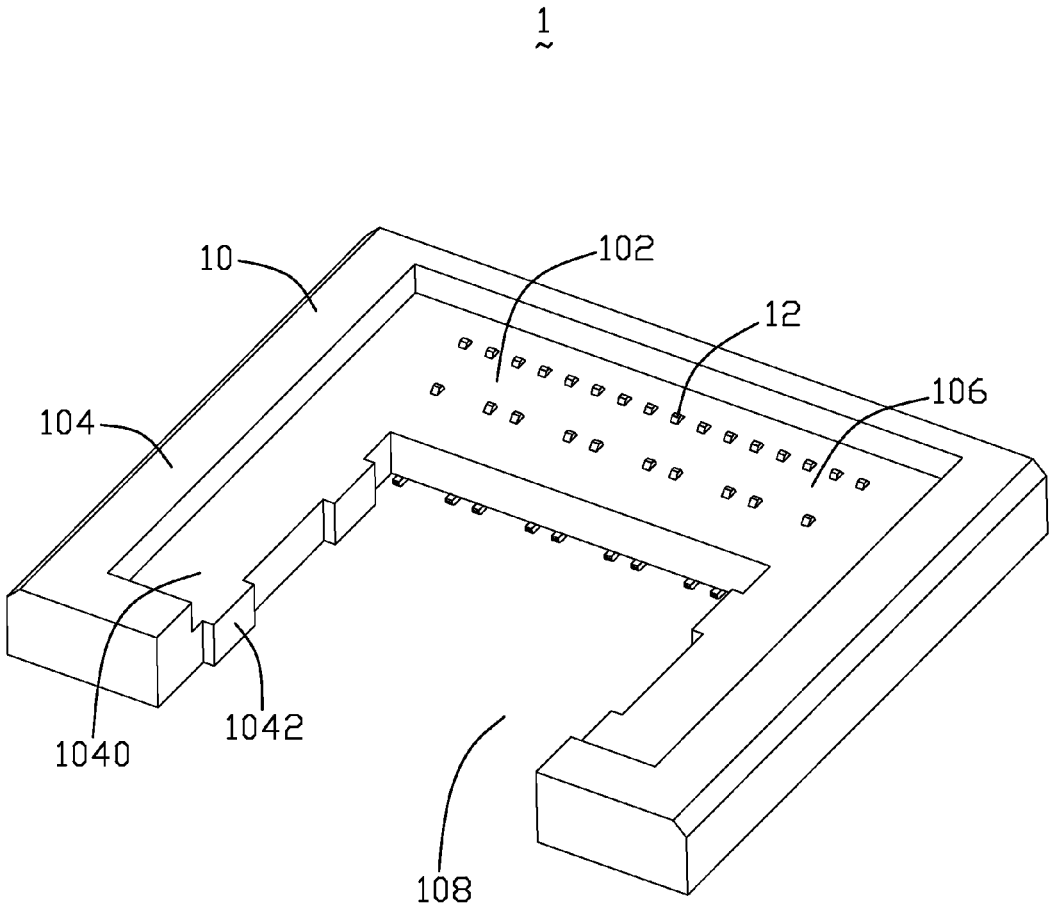
FIG. 1 is an isometric view of a socket connector in accordance with a preferred embodiment of the present invention.

Reference will now be made to the drawings to describe the present invention in detail.

Referring to FIGS. 1-7, a socket connector 1 in accordance with a preferred embodiment of the present invention is used for electrically connecting an electrical package 2 with a PCB (not shown). The connector 1 comprises an insulative housing 10 having a plurality of passageways 100 and a plurality of contact 12 respectively disposed in said passageways 100.

The insulative housing 10 includes a base 102 and two arms 104 extending from opposite ends of the base 102. The base 102 and the two arms 104 form a receiving cavity together for receiving the electrical package 2. The contacts 12 are arranged on the base 102 in a matrix manner.

Each of the arms 104 defines a supporting portion 1040 extending therefrom toward the other arm 104. A first cavity 106 is formed above an upper surface of the supporting portions 1040 and an upper surface of the base 102. A second cavity 108 is defined by sidewalls of the two supporting portions 1040 and sidewall of the base 102, which is located below the first cavity 106 and communicated with the first cavity 106 and outer space. In this embodiment, the first and second cavities 106, 108 form the receiving cavity jointly. Furthermore, upper surface of the supporting portion 104 and upper surface of the base 102 are disposed in a same plane.

Figure 3:
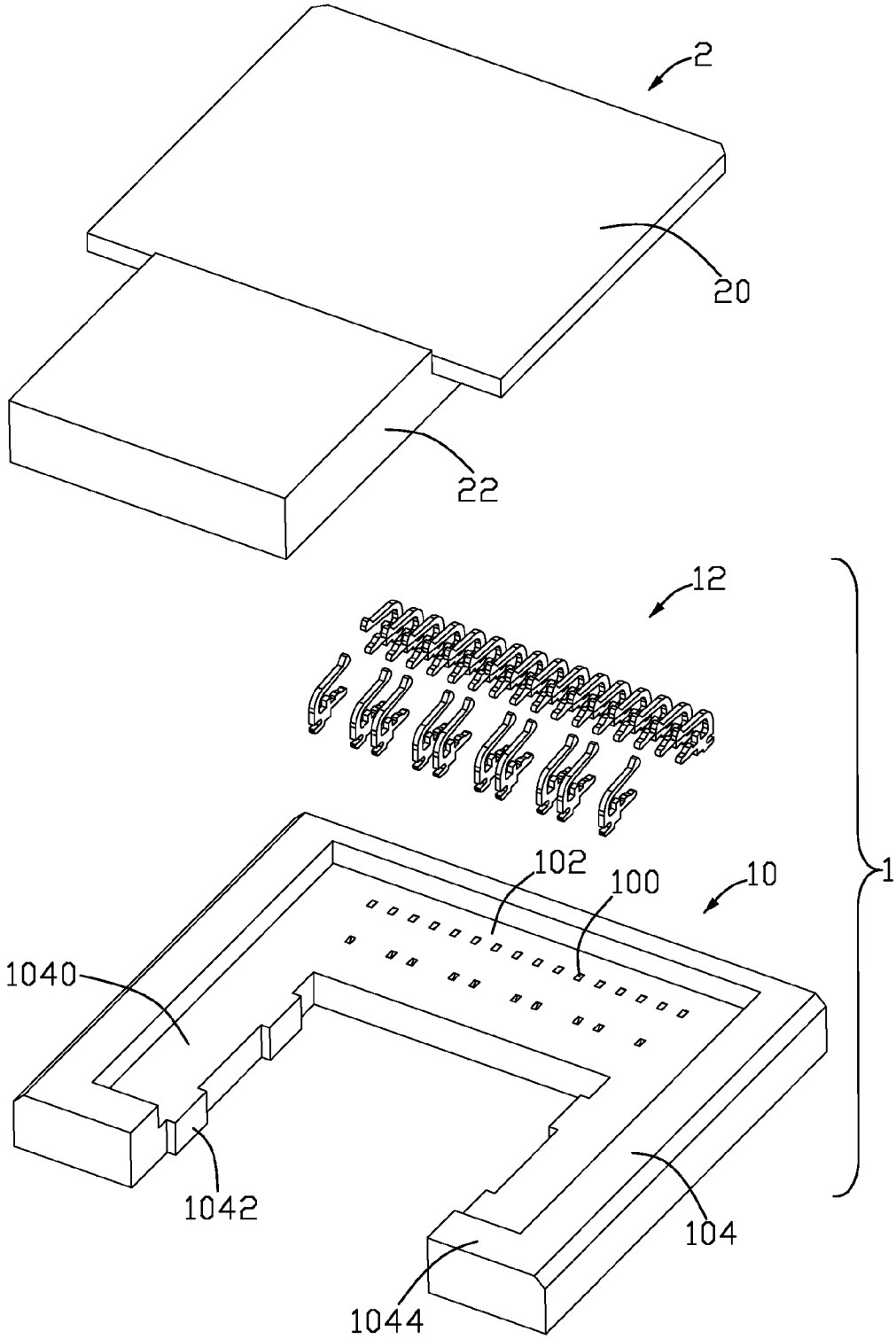
FIG. 3 is an isometric, exploded view of a socket connector, and an electrical package.
Figure 4:
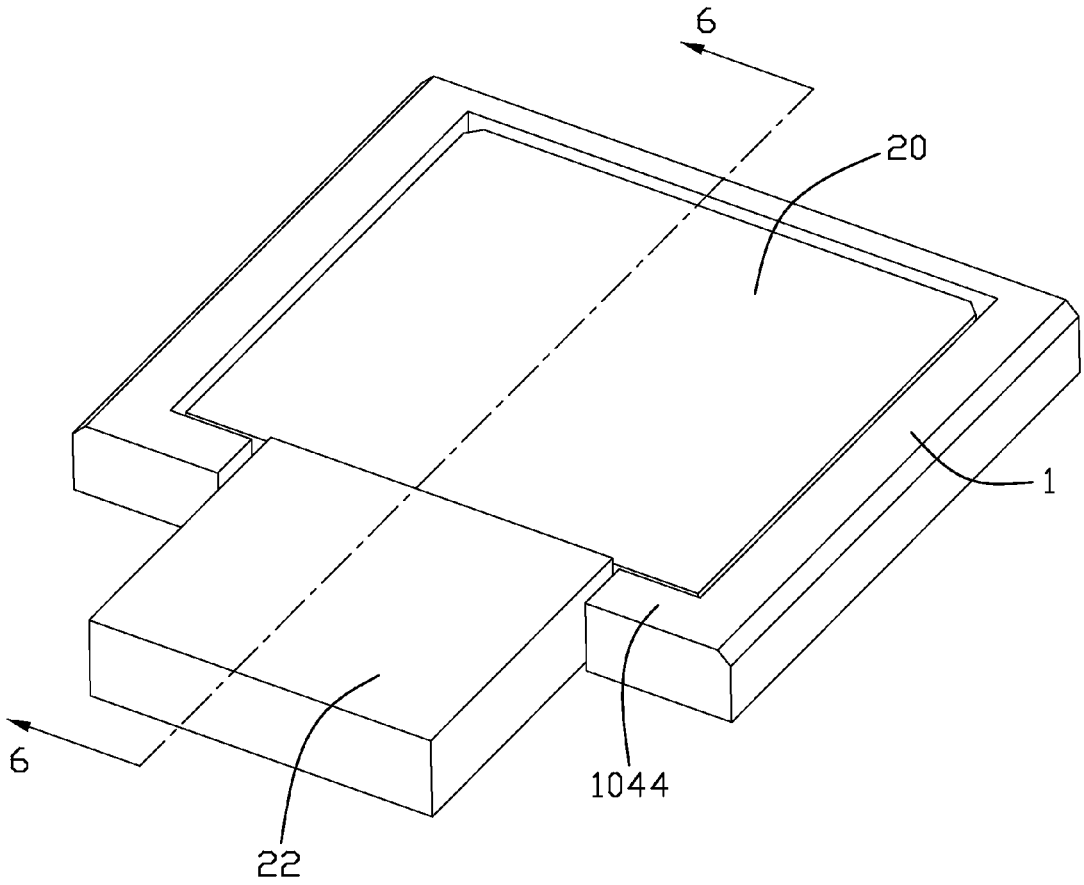
FIG. 4 is an assembly view of a socket connector and the IC package in accordance with a preferred embodiment of the present invention.
Figure 5:
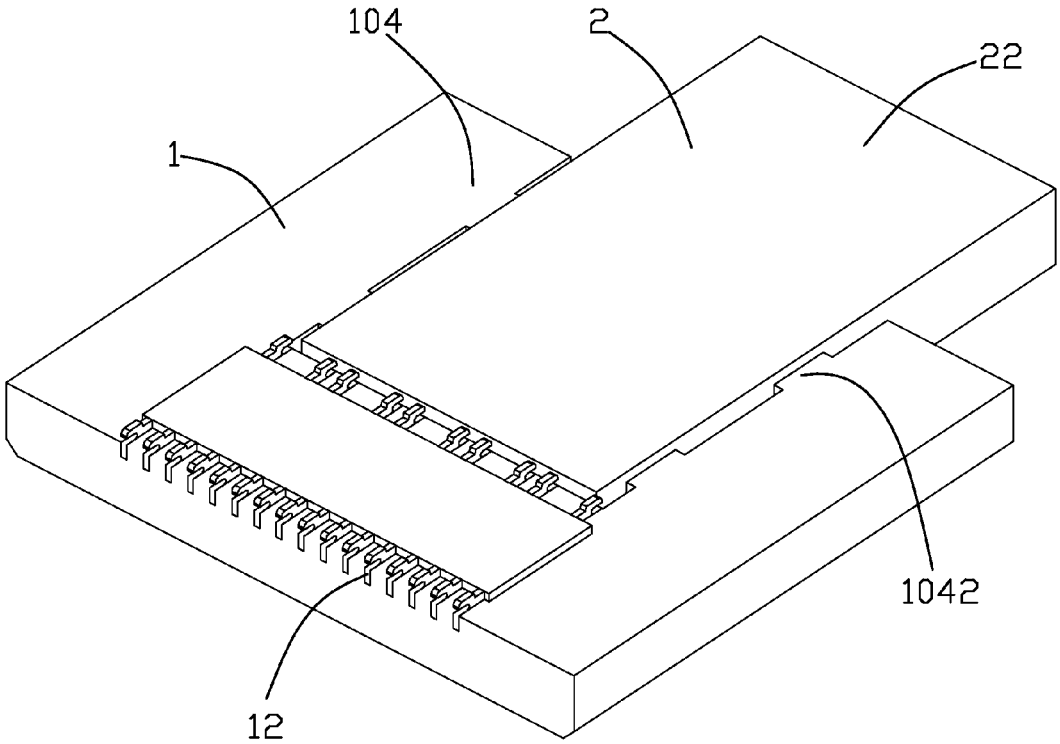
FIG. 5 is similar with FIG. 1, but from another angle.
Figure 6:
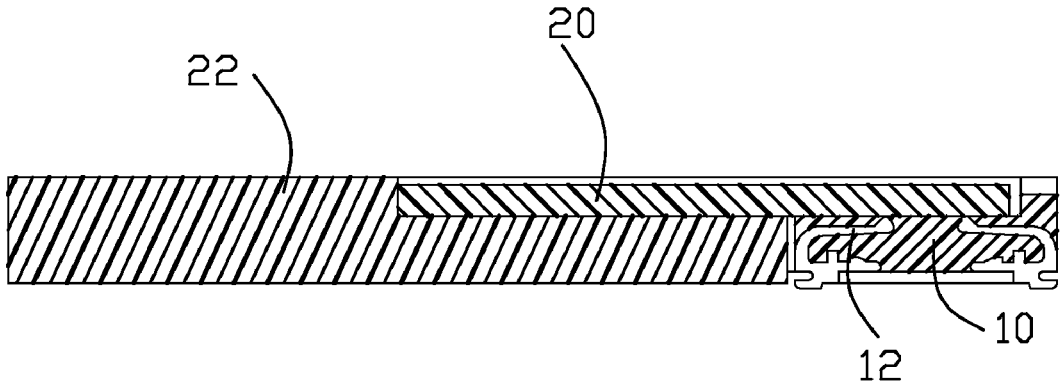
FIG. 6 is a cross-section view taker along line 6-6 shown in FIG. 4.
Figure 7:
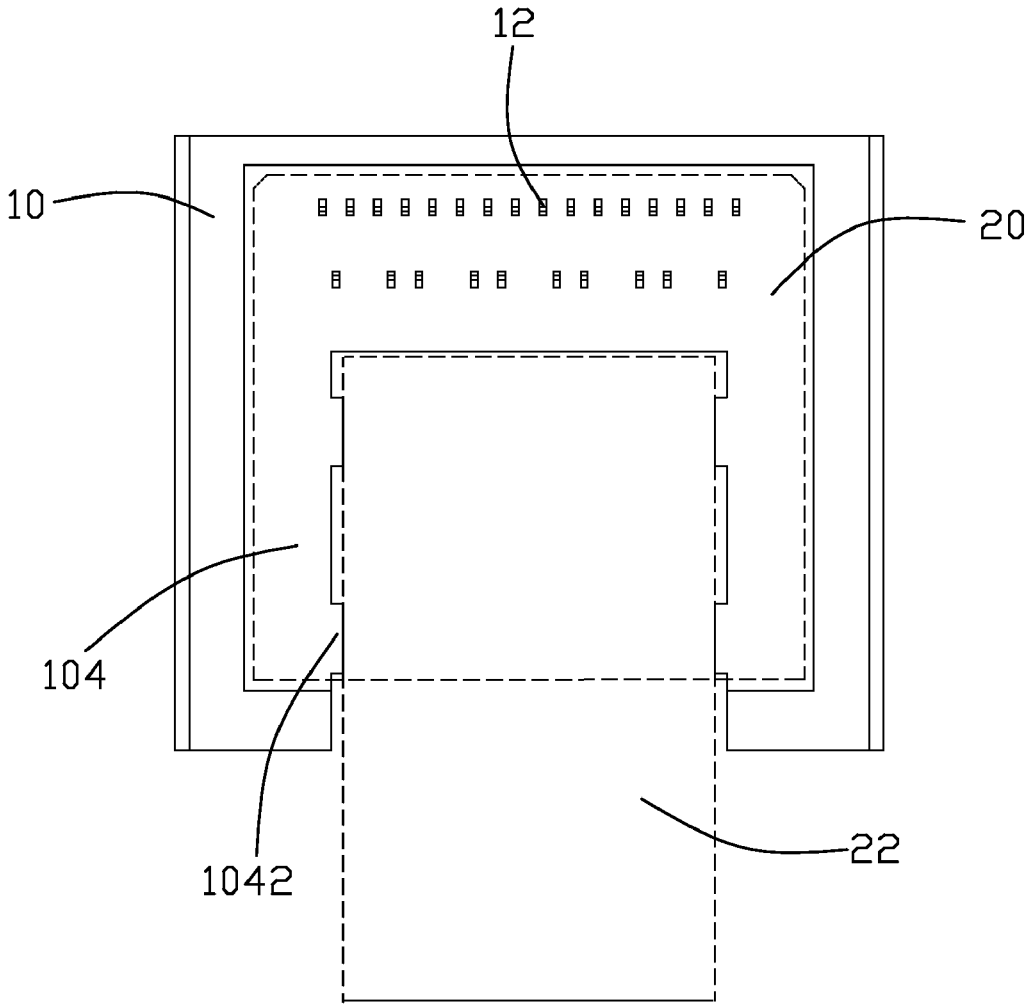
FIG. 7 is a top view of a socket connector of the present invention.

Referring to FIGS. 3-5, the electrical package 2 for using in the socket connector 1 includes a first part 20 and a second part 22 having a size smaller than the first part 20, for respectively receiving in the first cavity 106 and the second cavity 108.

Figure 2:
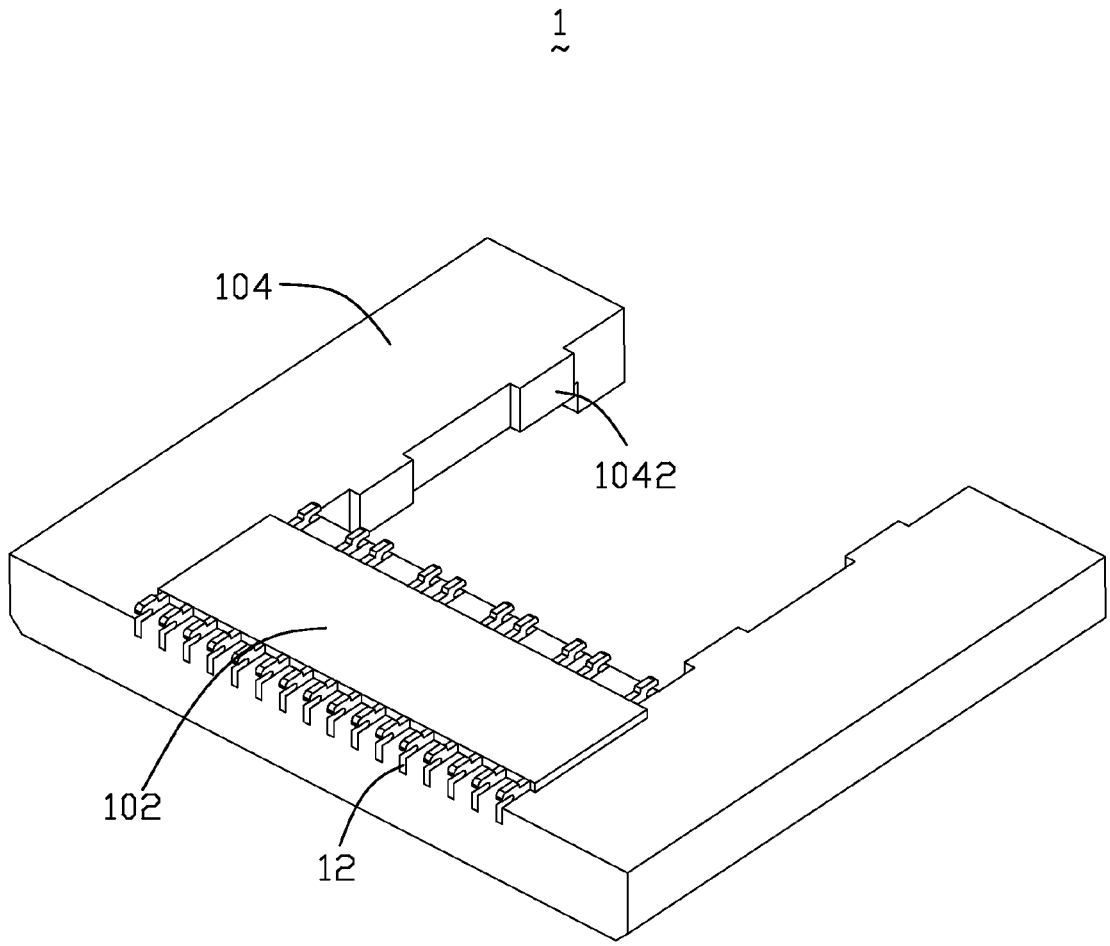
FIG. 2 is similar with FIG. 1, but from another angle.

Referring to FIGS. 1-3, in the second cavity 108, sidewall of each of the supporting portion 104 defines at least two standoffs 1042. Each of the arms 104 defines a stopper 1044 at a free end thereof, a top end of said stopper 1044 and the sidewalls of the supporting portion 104 is located at a same plane.

In use, the first and second parts 20, 22 of the electrical package 2 are respectively disposed in the first and second cavities 106, 108. The standoffs 1042 in the second cavity 108 is used for positioning the second part 22 of the electrical package 2. The first part 20 of the electrical package 2 is receiving the first cavity 106 and located on the upper surface of the supporting portions 104 and upper surface of the base 102. Accordingly, the electrical package 2 is mounted on the socket connector 1.

The second part 22 of the electrical package 2 has a smaller size than the other portion of the electrical package 2 and a smaller size. Accordingly, predetermined clearance between the sidewalls of the standoff 1042 and the electrical package 2 is smaller required than the conventional art. Therefore, when the electrical package 2 is inserted into the receiving cavity of the housing 10, it is easily to implement than before even under worse case, e.g. wrong operation.

While the preferred embodiment in accordance with the present invention has been shown and described, equivalent modifications and changes known to persons skilled in the art according to the spirit of the present invention are considered within the scope of the present invention as defined in the appended claims.

What is claimed is:

1. A socket connector for electrically connecting an electrical package to a PCB, comprising:

an insulative housing defining a plurality of passageways and a receiving cavity for receiving the electrical package;

a plurality of contacts respectively disposed in said passageways; wherein the receiving cavity comprises a first cavity, and a second cavity smaller than the first cavity; and the second cavity in communication with the first cavity and an outer space, the housing defining standoffs around the second cavity for positioning the electrical package when the electrical package is inserted into the receiving cavity;

wherein the insulative housing includes a base and two arms extending from opposite ends of the base, said receiving cavity formed by the base and arms jointly;

wherein each of said arms defines a supporting portion extending therefrom toward the other arm, said first cavity formed by above an upper surface of the supporting portions and the base;

wherein the two supporting portions are spaced to each other, the second cavity being formed by sidewalls of the two supporting portions and the sidewall of the base, which is locate below and communicated with the first cavity;

wherein the standoffs are arranged on the sidewall of the supporting portion;

wherein each of the arms defines a stopper at a free end thereof, a top end of said stopper and the sidewalls of the supporting portion located at a same plane.

2. The socket connector as claimed in claim 1, wherein contacts are arranged on the base.

3. The socket connector as claimed in claim 1, wherein the first cavity is higher than the second cavity, and the contacts upwardly extend into the first cavity while the standoffs horizontally extend into the second cavity.

4. An socket connector assembly comprising:

an electrical package including a first part and a second part having a size smaller than the first part;

a socket connector comprising an insulative housing defining a plurality of passageways and a receiving cavity for receiving the electrical package and a plurality of contacts respectively disposed in said passageways; wherein the receiving cavity comprises a first cavity, and a second cavity smaller than the first cavity for receiving the first, second parts of the electrical package, respectively; and the second cavity in communication with the first cavity and an outer space, and the housing defining at least one standoff around the second cavity to position and align the second part of the electrical package in the second cavity.

5. The socket connector assembly as claim 4, wherein the first cavity is higher than the second cavity, and the contacts extend upward into the first cavity while the standoff extend horizontally into the second cavity.

6. The socket connector assembly as claimed in claim 4, wherein the insulative housing includes a base and two arms extending from opposite ends of the base, said receiving cavity formed by the base and arms jointly.

7. The socket connector as claimed in claim 6, wherein contacts are arranged on the base.

8. The socket connector assembly as claimed in claim 7, wherein each of said arms defines a supporting portion extending therefrom toward the other arm, said first cavity formed by above an upper surface of the supporting portions and the base.

9. The socket connector assembly as claimed in claim 8, wherein the two supporting portions are spaced to each other, the second cavity being formed by sidewalls of the two supporting portions and the sidewall of the base, which is locate below and communicated with the first cavity.

10. The socket connector assembly as claimed in claim 9, wherein the standoffs is arranged on the sidewall of the supporting portion.

11. The socket connector assembly as claimed in claim 10, wherein each of the arms defines a stopper at a free end thereof, top end of said stopper and the sidewalls of the supporting portion located at a same plane.

* * * * *